US008246901B2

(12) United States Patent
Sarres et al.

(10) Patent No.: US 8,246,901 B2
(45) Date of Patent: Aug. 21, 2012

(54) RETORT FURNACE FOR HEAT TREATING METAL WORKPIECES

(75) Inventors: Rolf Sarres, Oberhausen (DE); Heinz Schwall, Eschweiler (DE)

(73) Assignee: Ipsen, Inc., Cherry Valley, IL (US)

( * ) Notice: Subject to any disclaimer, the term of this patent is extended or adjusted under 35 U.S.C. 154(b) by 0 days.

(21) Appl. No.: 13/012,185

(22) Filed: Jan. 24, 2011

(65) Prior Publication Data

US 2011/0115138 A1 May 19, 2011

Related U.S. Application Data

(62) Division of application No. PCT/DE2009/000963, filed on Jul. 13, 2009.

(30) Foreign Application Priority Data

Jul. 14, 2008 (DE) ..... 20 2008 009 980 U

(51) Int. Cl.
*C21D 1/74* (2006.01)

(52) U.S. Cl. ..... 266/255; 219/213; 266/252

(58) Field of Classification Search ..... 266/252, 266/255, 257, 262; 219/213; 432/208, 261
See application file for complete search history.

(56) References Cited

U.S. PATENT DOCUMENTS

| | | | | |
|---|---|---|---|---|
| 3,565,410 A | | 2/1971 | Scherff | |
| 4,195,820 A | | 4/1980 | Berg | |
| 4,259,060 A | | 3/1981 | Korzeb et al. | |
| 4,352,969 A | | 10/1982 | Wulf | |
| 4,610,435 A | * | 9/1986 | Pfau et al. | 266/250 |
| 4,612,064 A | * | 9/1986 | Schmetz | 148/712 |
| 4,770,630 A | * | 9/1988 | Akimoto et al. | 432/121 |
| 4,854,863 A | | 8/1989 | Hemsath | |
| 2004/0007565 A1 | | 1/2004 | Moller | |
| 2004/0009448 A1 | | 1/2004 | Kisoda | |

FOREIGN PATENT DOCUMENTS

| | | |
|---|---|---|
| DE | 2010433 B | 3/1972 |
| DE | 2054666 A1 | 5/1972 |
| DE | 2126474 A1 | 11/1972 |
| DE | 3631389 C2 | 3/1987 |

(Continued)

OTHER PUBLICATIONS

Written Opinion of the International Searching Authority, PCT/DE2009/000963, pp. 1-14, issued Apr. 21, 2011.

(Continued)

*Primary Examiner* — Scott Kastler
*Assistant Examiner* — Michael Aboagye
(74) *Attorney, Agent, or Firm* — Dann, Dorfman, Herrell and Skillman, P.C.

(57) ABSTRACT

A furnace (1), which, for the heat treatment of metal workpieces, has a tubular metal retort (3) and a furnace housing (2) enclosing the retort (3), the retort (3) comprising a gastight closable treatment or batch space (10), which receives the protective and reactive gases, for the heat treatment of the workpieces and a receptacle framework (8) as a batch receptacle for the positioning thereof, the weight of the batch and the receptacle framework (8) is decoupled from the retort (3), the receptacle framework (8) is connected to means (5) for support on the furnace housing (2), and the means (5) are guided gastight in passages (6) of a wall (2.1) of the furnace housing (2) and a wall (3.1) of the retort (3).

11 Claims, 3 Drawing Sheets

FOREIGN PATENT DOCUMENTS

| | | | | |
|---|---|---|---|---|
| DE | 10312650 | | * | 9/2004 |
| DE | 10312650 | B3 | | 9/2004 |
| DE | 10338431 | A1 | | 3/2005 |
| GB | 2009897 | A | | 6/1979 |
| WO | 2005073413 | A1 | | 8/2005 |

OTHER PUBLICATIONS

International Search Report, PCT/DE2009/000963, dated Jan. 28, 2011.

* cited by examiner

RETORT FURNACE FOR HEAT TREATING METAL WORKPIECES

CROSS REFERENCE TO RELATED APPLICATIONS

This application is a Division of International Application No. PCT/DE2009/000963 filed Jul. 13, 2009 which designates the United States. The entire disclosure of said international application is incorporated herein by reference.

BACKGROUND OF THE INVENTION

1. Field of the Invention

The invention relates to a retort furnace for the heat treatment, for example, the blank annealing, annealing under nitrogen or nitrogen/hydrogen, nitriding, or nitrocarburizing of metal workpieces.

2. Description of the Related Art

Retort furnaces for the heat treatment of metal workpieces are known in manifold configurations according to the prior art, for example, according to DE-AS 2 010 433, DE-OS 27 54 034, DE 30 28 952 C2, DE 31 43 532 A1, DE 36 31 389 C2, and DE 103 38 431 A1.

The invention does prefer horizontal retort furnaces, which essentially have a recumbent tubular retort, a furnace housing which encloses the retort with thermal insulation, and a unit for heating the retort, but it is also transferable to other constructions of retort furnaces.

The retort typically has

- a treatment or batch space, which receives the protective and reactive gases and is closable gastight, for the heat treatment of the workpieces as batches and
- appropriate frameworks for the expedient positioning and receiving/support of the batches.

During the heat treatment, the heating to temperatures up to 650° C. is substantially supported by convection. An effort is made for an intensive circulation of the furnace atmosphere which encompasses the workpieces on all sides within the retort. For this purpose, circulation assemblies and gas guiding aids situated in the area of the retort are used.

In particular during the heat treatment, the retorts are subjected to high strain. They are implemented having wall thicknesses greater than 8 mm because of the dimensional stability.

At least in the retort furnaces of the above-described type, in contrast, spot-shaped stresses result in the lower part of the retorts, which are horizontal in this case, due to the batch weights and the support elements of the receptacle frameworks. It is disadvantageous that the stresses rise with increasing batch weight, while in contrast the carrying capacity of the retort material decreases with increasing furnace temperature. Therefore, the loading capacity and the efficiency of the heat treatment of the workpiece batches of such retort furnaces are limited.

The technical world has already concerned itself with preventing harmful strains of retorts during the heat treatment of metal workpieces. However, such solutions only relate to the relief of the retort floor in the case of vertically situated retorts by supports and/or by load-carrying means for support in relation to a housing as described, for example, in DE 2 054 666 A.

The strain of the retorts due to the batch weights themselves and their receptacle frameworks was taken into consideration, but the efficiency of the heat treatment was not increased.

Furthermore, a compensator technology (IHU) was known from the exclusively vertical furnace construction, in which the entire batch load rests on a heat resistant pedestal made of concrete and is supported thereon. The retort, whose impact is compensated for via a compensator, can thus be implemented having a thinner wall thickness, and its service life lengthens because of the reduced load.

However, in addition to undeniable advantages, disadvantages also result from this solution, such as:

- The solution is not transferable to horizontal configurations.
- The pedestal and further ceramic insulation materials and supports may bind moisture which is harmful for subsequent processes.
- The compensator is relatively large and costly because of its construction; it forms heat bridges and causes energy losses.
- The configuration in the floor encourages the transition to lower temperatures and the formation of condensate, which is more difficult than water vapor to remove from the retort.

In addition, a heat treatment furnace, in particular a pressure sintering furnace having a furnace housing and an insulation cage, which is held by the furnace housing and forms a boiler room and encloses it at a distance, and a muffle, which is situated in the interior of the insulation cage, envelops the workpiece batch, and delimits an insulation space with the insulation cage, was already described in DE 103 12 650 B3. It also comprises so-called supports as a type of receptacle framework for the batch. Transferring this solution to retort furnaces according to the species of the type described at the beginning would not result in increasing the efficiency of the heat treatment of the workpiece batches and the loading capacity of the retorts.

BRIEF SUMMARY OF THE INVENTION

The object of the invention is, in the case of retort furnaces which essentially have a tubular metal retort, a furnace housing enclosing the retort, and a unit for heating the retort,

- to increase the efficiency of the heat treatment of the workpiece batches and the loading capacity of the retort,
- to reduce the wall thickness of the retort, so that its mass decreases,
- to concentrate the retort on the function of the gastight closable treatment or charge space,
- to implement a rapid atmosphere change, avoid contaminants of the protective gas atmosphere, and avoid harmful effects on the heat treatment process.

The invention fundamentally achieves this stated object in that the weight of the batch and the receptacle framework is decoupled from the retort and the receptacle framework is connected to means for support on the furnace housing and these means are guided gastight in passages of the walls of the retort and the surrounding furnace housing.

In contrast to the prior art, the retort is therefore not only relieved of the weight of the batch and the receptacle framework, but rather the stated object is also achieved of increasing the efficiency of the heat treatment of the workpiece batches, reducing the mass and the wall thickness of the retort, orienting the retort to the function of the gastight closable treatment or batch space, and achieving an increased loading capacity of the retort overall.

In the implementation according to the invention, the receptacle framework is connected by suspension to means for support on the furnace housing.

For this purpose, the furnace housing has crossbeams for attaching the means, and the means are connected via joints to both the receptacle framework and also via the crossbeams to the furnace housing.

The passages in the walls encompass incorporated pipes having gastight compensators, which compensate for a length expansion and ensure a movement freedom of the means in the pipes during heat-related expansions of the retort in particular.

Furthermore, appropriate seals and, in addition, cooling bags, which are filled with a coolant such as water, and insulators for protecting the compensators from high heat are assigned to the pipes having the gastight compensators.

A completed embodiment according to the invention provides that the pipes incorporated in the walls are each partitioned using removable flange connections into a first or bottom part and second or top part, the bottom part being incorporated in at least one of the walls and the top part being incorporated in the crossbeam. The top part has a folded bellows sleeve which assumes the function of the compensator, and the bottom part is enclosed by the cooling bag.

At least one module, which forms the pipes having compensators, such as the top part having the folded bellows sleeve assuming the function of the compensator, or the bottom part enclosed by the cooling bag, is situated so it is replaceable.

Finally, the invention is also implemented in that the retort having the means for support on the furnace housing can be taken out without removing the means in that the wall of the furnace housing has a removably situated segment, which encloses an area of the passages.

Various design solutions may be listed by a person skilled in the art for this purpose, which ensure that at least one of the features relating to the subject matter of the invention is fulfilled, such as

- the receptacle framework remains connected to means for support on the furnace housing,
- the means remain guided gastight in passages of a wall of the furnace housing and a wall of the retort,
- the receptacle framework remains connected by suspension to the means for support on the furnace housing,
- the means are supported via crossbeams on the furnace housing, and/or
- the means are supported both to the receptacle framework and also to the crossbeams (9) via joints on the furnace housing.

The function of the retort is reduced to the gastight closure of the treatment space solely by these design measures according to the invention, and the thickness of the wall of the retort can thus be reduced from 10 mm to 5 mm, for example.

In addition, the reduction of the wall of the retort causes a more rapid heat conduction through the wall, whereby the heat transfer speed increases.

Through the direct transfer of the heat between the reduced wall of the retort to the batch, the possibility also results of dispensing with gas guiding conduction units such as gas guiding cylinders, which would act as disadvantageous radiation shields in this case. This in turn causes cooler furnace gas to heat more rapidly in contact with the retort.

BRIEF DESCRIPTION OF THE VIEWS OF THE DRAWINGS

In the associated drawings

DETAILED DESCRIPTION OF THE INVENTION

The invention is described in greater detail on the basis of a constructively implemented example.

Figure 1:
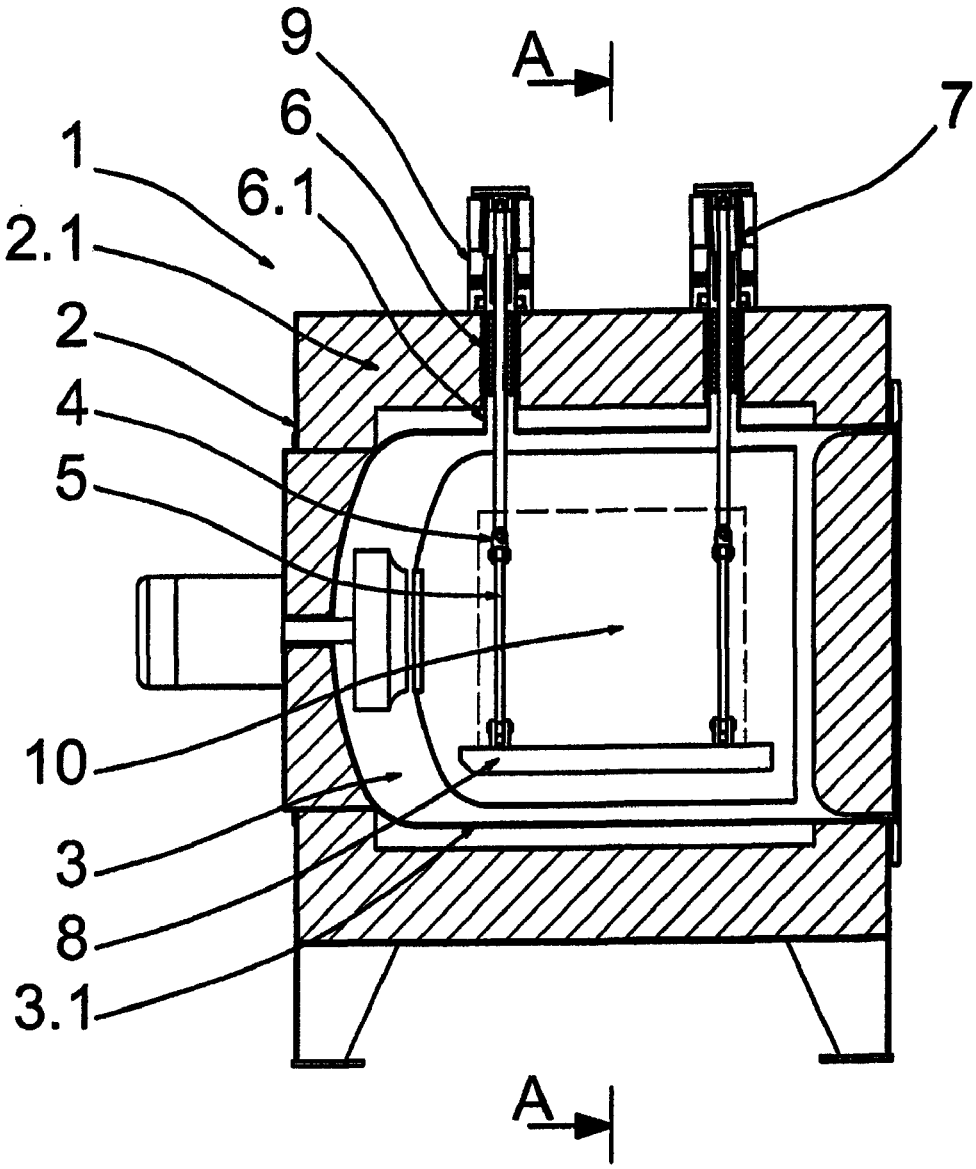
FIG. 1 shows a longitudinal section through a horizontal retort furnace according to the invention.
Figure 2:
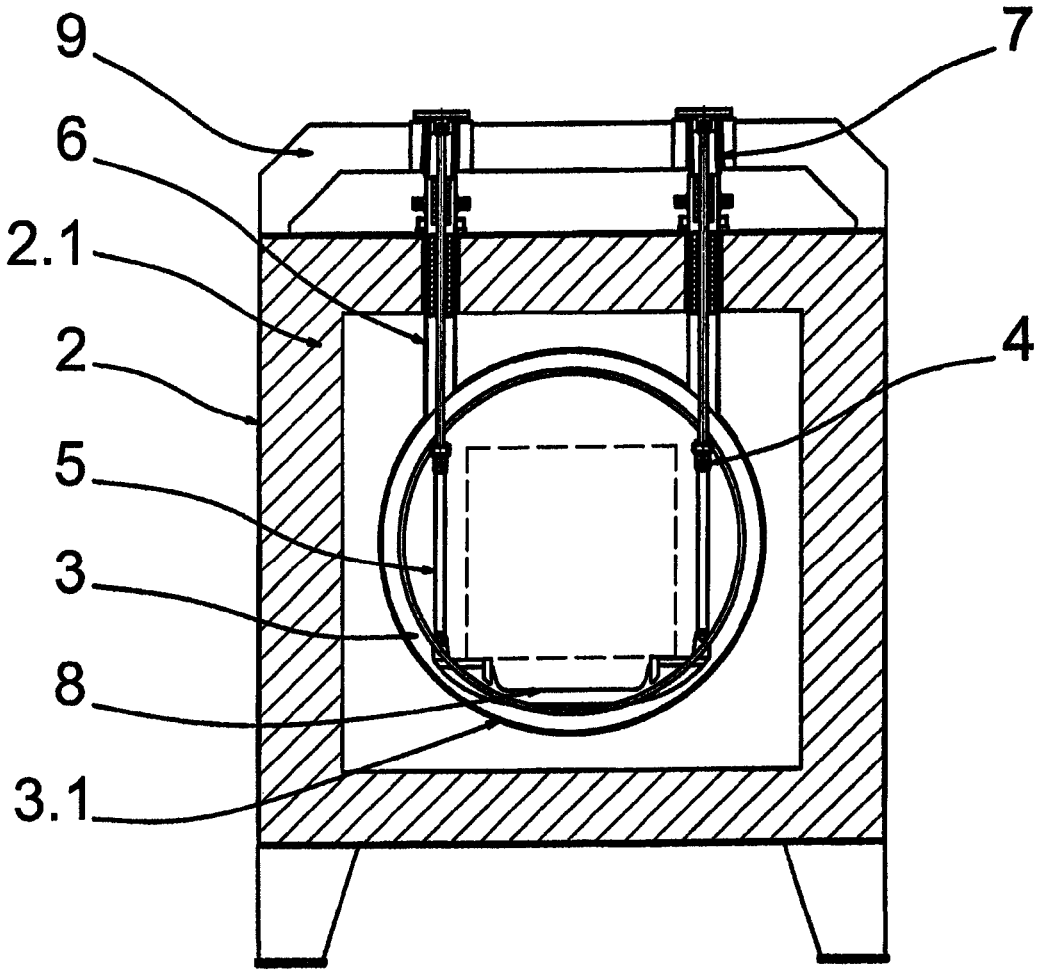
FIG. 2 shows cross-section A-A from FIG. 1.

According to FIGS. 1 and 2, a retort furnace 1 for the heat treatment of metal workpieces (not shown) comprises a horizontal tubular metal retort 3, and a furnace housing 2 which encloses the retort 3. The retort 3 has a gastight closable treatment or batch space 10, which accommodates the protective and reactive gases, for the heat treatment of the workpieces as a batch and a receptacle framework 8 for the positioning thereof as a batch receptacle.

Heating elements (not shown here), are received by the furnace housing 2, which heat the retort 3 having the treatment or batch space 10 for the heat treatment of the workpieces as a batch in a protective gas atmosphere. In addition, a ventilator unit (not designated) and a conduction unit (not designated) for guiding the protective gas atmosphere in the retort 3 are assigned to the retort furnace 1.

The retort 3 is closed at one end—also not designated here—and is provided at the other end with a charging opening, which is closable gastight by a cover, for the batch.

The implementation of these parts, which are only shown for the sake of completeness but are not designated, are not significant for the function according to the invention here.

In relation to the prior art discussed at the beginning, the invention is distinguished by the combination of the following features with respect to the receptacle framework 8 having the following novel design principle:

a) The weight of the batch and the receptacle framework 8 is decoupled from the retort 3, b) for which purpose the receptacle framework 8 is connected to means 5 for support on the furnace housing 2, and c) the means 5 are guided gastight in passages 6 of a wall 2.1 of the furnace housing 2 and a wall 3.1 of the retort 3.

This revised principle provides the condition in order to

- reduce the wall thickness of the retort so that its mass decreases, and
- increase the efficiency of the heat treatment of the workpiece batches and the loading capacity of the retort.

It can be seen from FIG. 1 and FIG. 2 that to decouple the weight of the batch and the receptacle framework 8 from the retort 3, the receptacle framework 8 is connected by suspension to means 5 for support on the furnace housing 2, the means 5 are supported via crossbeams 9 and by connecting joints 4 on the furnace housing 2 both to the receptacle framework 8 and also to the crossbeams 9.

Furthermore, FIG. 1 and FIG. 2 show that the passages 6 have pipes 6.1, which extend through the walls 2.1, 3.1, and have expansion compensating, gastight compensators 7. According to FIG. 3, the pipes 6.1 are preferably surrounded by cooling bags 7.2.

The pipes 6.1 are connected to the crossbeams 9 to form gastight units by means of the compensators 7 and insulators 7.3 as well as seals (not shown). The compensators 7 allow the compensation of movements which the pipes 6.1 experience during the heat-related expansion of the retort 3. The cooling bags 7.2, which are filled with water, for example, and the insulators 7.3 prevent undesirable heating of the compensators 7.

The fulfillment of the stated object of the invention is completed in that the function of the retort 3 is reduced to the gastight closure of the batch space 10 and a more rapid atmosphere change may be implemented and contaminants of the protective gas atmosphere and harmful effects on the heat treatment process are avoided.

The reduction achieved according to the invention of the thickness of wall 3.1 of the retort 3 causes more rapid heat conduction, whereby the efficiency of the heat treatment is increased.

Furthermore, the reduction of the wall thickness causes a decrease of the retort weight. Energy is thus saved during the heating of the furnace to the heat treatment temperature.

Overall, it has been shown that batch weights of up to 5 tons may be heat treated as intended using this design principle according to the invention.

Figure 3:
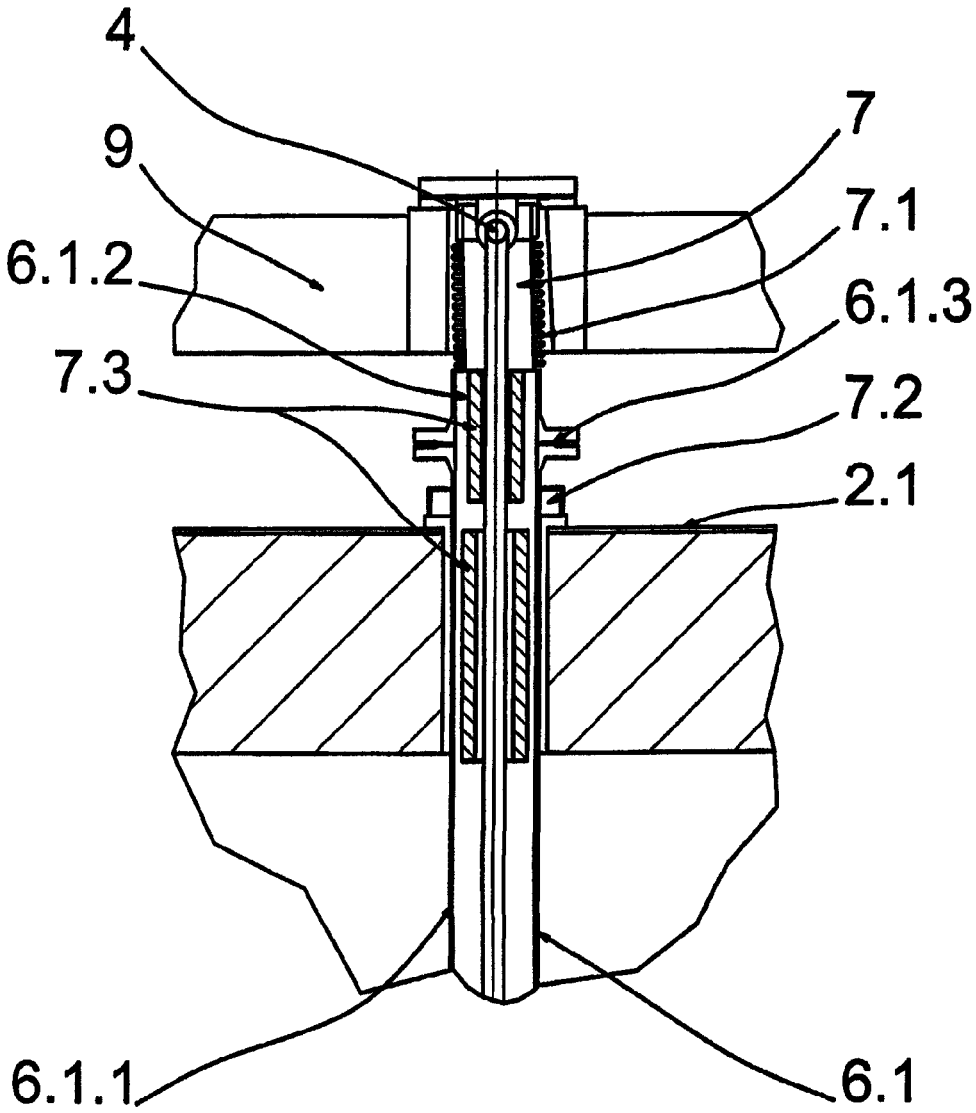
FIG. 3 shows a cutout detail from FIG. 1 and FIG. 2.

FIG. 3 shows details of a preferred design embodiment of the suspension arrangement according to the present invention. The pipes 6.1 extending through the walls 2.1, 3.1 are each partitioned outside, above the furnace housing 2 here, using removable flange connections 6.1.3 on a bottom part 6.1.1 and on a top part 6.1.2. The bottom part 6.1.1 extends through at least one of the walls 2.1, 3.1, and the top part 6.1.2 is connected to the crossbeam 9. The top part 6.1.2 is equipped with a folded bellows sleeve 7.1, which performs the function of the compensator 7. The bottom part 6.1.1 is surrounded by the cooling bag 7.2 preferably adjacent to the wall 2.1.

At least one module formed of the pipes 6.1 and the compensators 7 is adapted as a disposable/replacement part, for example, which is shown in particular in FIG. 3.

Another advantage of the invention is also effectively realized in that the retort 3 having the supporting means can be taken out of the furnace housing 2 without disassembly of the furnace housing.

For this purpose, the wall 2.1 of the furnace housing 2 has a removably situated segment (not shown in greater detail)—which encloses an area of the passages 6—and which is not described in detail here because of the multiple design possibilities according to the conditions cited at the beginning.

However, in FIG. 2, this maintenance friendly removability is indicated in the design by a separability of the furnace housing 2.

Overall, the exemplary embodiment shows that to decouple the weight of the batch and the receptacle framework 8 from the retort 3, the receptacle framework 8 is connected by a suspension to means 5 for support on the exterior of the furnace housing 2. The support means 5 are supported on top of the furnace housing by the crossbeams 9 and connected to the receptacle framework 8 and also to the crossbeams 9 by connecting joints 4 on the furnace housing 2.

The invention is not restricted to the design configuration shown in the drawings and described above. Accordingly, to decouple the weight of the batch and the receptacle framework 8 from the retort 3, the receptacle framework 8 can alternatively be connected vertically to support means 5 for support on the furnace housing 2 and the support means 5 can be supported on the bottom by crossbeams 9 on the bottom of the furnace housing 2, for example.

Further design embodiments are possible in the scope of the idea of the invention, of how a) the weight of the batch and the receptacle framework 8 is decoupled from the retort 3,
b) for which purpose the receptacle framework 8 is connected to means 5 for support on the furnace housing 2, and
c) the means 5 are guided gastight in passages 6 of a wall 2.1 of the furnace housing 2 and a wall 3.1 of the retort 3.

INDUSTRIAL APPLICABILITY

The effects achieved by the design arrangement according to the invention of the suspension of the receptacle framework 8 provide a substantial usage value increase and an increased availability of retort furnaces in the applicable industry.

LIST OF REFERENCE NUMERALS

1 retort furnace
2 furnace housing
2.1 wall of the furnace housing
3 tubular metal retort
3.1 wall of the retort
4 joint
5 means for support
6 passage
6.1 pipe
6.1.1 first or bottom part
6.1.2 second or top part
6.1.3 flange connection
7 compensator
7.1 folded bellows sleeve
7.2 cooling bag
7.3 insulation
8 receptacle framework
9 crossbeam
10 treatment or batch space

The invention claimed is:

1. A retort furnace (1) for heat treating metal workpieces, having a furnace housing (2) enclosing a metal retort (3), the retort (3) comprising a gastight closable treatment or batch space (10) for the heat treatment of a batch of the metal workpieces and a receptacle framework (8) as a batch receptacle for positioning thereof, wherein a) the weight of the batch of metal workpieces and the receptacle framework (8) is decoupled from the retort (3),
b) the receptacle framework (8) is connected to means (5) for support on the furnace housing (2),
c) the support means (5) are guided in gastight passages (6) through a wall (2.1) of the furnace housing (2) and a wall (3.1) of the retort (3),
d) the gastight passages (6) comprising pipes (6.1) that extend through the walls (2.1, 3.1), and length-compensating compensators (7) operably connected to said pipes (6.10).

2. The retort furnace according to claim 1, wherein the receptacle framework (8) is connected by a suspension to the support means (5) for support on the furnace housing (2).

3. The retort furnace according to claim 1 or 2, wherein the support means (5) are supported via crossbeams (9) on the furnace housing (2).

4. The retort furnace according to claim 1 wherein the support means (5) supporting the receptacle framework (8) and are also connected to the crossbeams (9) by connecting joints (4) on the furnace housing (2).

5. The retort furnace according to claim 1 comprising at least one cooling bag (7.2) that surrounds each of the pipes (6.1).

6. The retort furnace according to claim 1 wherein the pipes (6.1) comprise insulators (7.3).

7. The retort furnace according to claim 1 wherein the pipes (6.1) are each partitioned outside the furnace housing (2) using removable flange connections (6.1.3) into a first or bottom part (6.1.1) and a second or top part (6.1.2), the first or bottom part (6.1.1) extending through at least one of the walls (2.1, 3.1) and the second or top part (6.1.2) being connected to the crossbeams (9).

8. The retort furnace according to claim 7, wherein the second or top part (6.1.2) comprises a folded bellows sleeve (7.1), which performs the function of the compensator (7).

9. The retort furnace according to claim 8, wherein the cooling bag (7.2) surrounds the first or bottom part (6.1.1).

10. The retort furnace according to claim 9, wherein each of the pipes (6.1) and each of the associated compensators (7) is assembled so as to be replaceable.

11. The retort furnace according to claim 1 wherein the retort (3) having the support means (5) can be taken out of the furnace housing (2) without dissembling the furnace housing, the wall (2.1) of the furnace housing (2) having a removable segment that encompasses at least an area of the passages (6) for this purpose.

* * * * *